United States Patent [19]

Cramer

[11] 4,226,286

[45] Oct. 7, 1980

[54] PITLESS ADAPTER

[76] Inventor: Harold E. Cramer, 10783 County Rd. 9, Findlay, Ohio 45840

[21] Appl. No.: 5,059

[22] Filed: Jan. 22, 1979

[51] Int. Cl.[3] ..... E21B 33/03

[52] U.S. Cl. ..... 166/85; 166/88

[58] Field of Search ..... 166/88, 85, 86, 87, 166/100, 124, 139, 206

[56] References Cited

U.S. PATENT DOCUMENTS

| | | | |
|---|---|---|---|
| 3,270,818 | 9/1966 | Pugh, Jr. | 166/88 X |
| 3,403,730 | 10/1968 | Williams | 166/88 |
| 3,563,310 | 2/1971 | Wellstein | 166/85 |
| 3,722,586 | 3/1973 | Baker | 166/85 |
| 3,782,462 | 1/1974 | Kramer | 166/88 |
| 4,042,021 | 8/1977 | Forsell | 166/88 X |
| 4,056,144 | 11/1977 | Wellstein | 166/88 X |

OTHER PUBLICATIONS

*The American Heritage Dictionary of the English Language,* 1976, Houghton Mifflin Co., Boston, pp. 1173, 1175.

*Primary Examiner*—Stephen J. Novosad

*Attorney, Agent, or Firm*—Wheeler, Morsell, House & Fuller

[57] ABSTRACT

A pitless adapter for a well casing is provided with an O-ring seal surrounding the opening in the well casing for the outlet from the pitless adapter to the service pipe. A downwardly facing hook within the area sealed by the O-ring supports the pitless adapter on the lip of the opening in the well casing. A sector shaped locking member on the opposite side of the pitless adapter from the outlet rides in a sector-shaped slot in the pitless adapter and is engaged at the top end of the sector by a screw capable of forcing the sector against the wall of the well casing to force the pitless adapter securely against the wall of the well casing. The locking member is provided with an arcuate channel on its side in which a high friction device such as a rubber pellet is inserted to retain the sector against moderate displacing forces, particularly during insertion of the pitless adapter into the well casing.

4 Claims, 4 Drawing Figures

Fig. 3
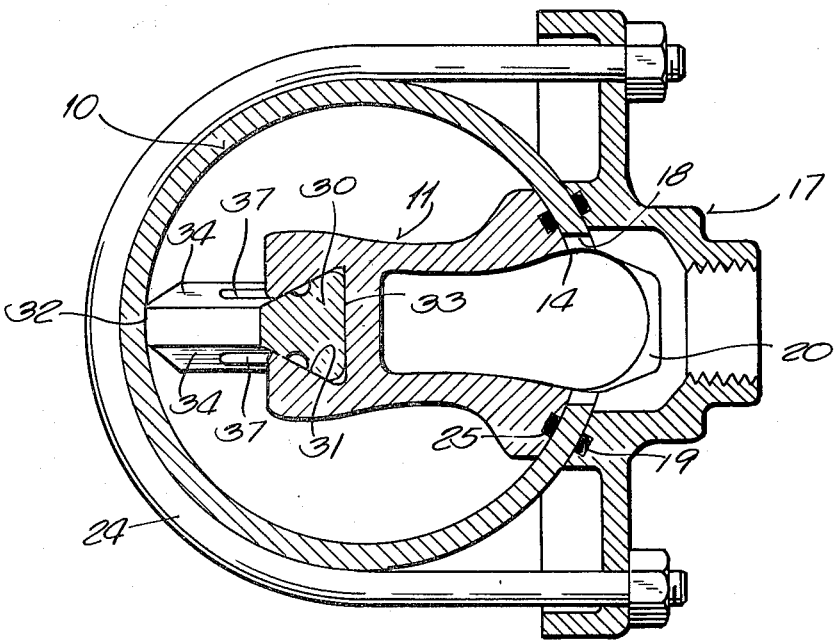
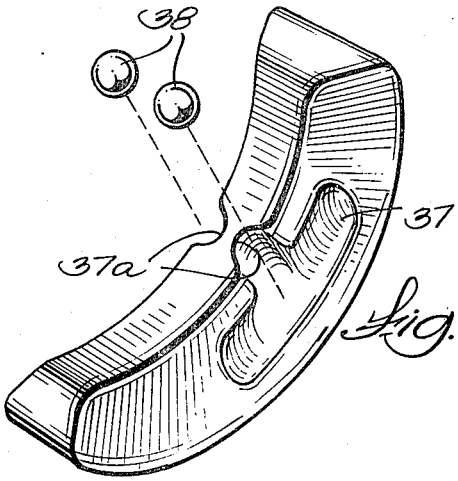
Fig. 4

PITLESS ADAPTER

BACKGROUND OF THE INVENTION

A great many devices are known in the pitless adapter field. There is a continuing problem in placing such devices within a well casing easily, quickly, and without O-ring damage, by personnel who are relatively unskilled and who must yet do a job that will work perfectly and continue to do so for many years without service. The adapter should then be withdrawn from the well readily for service. Patents on such devices known to me include the following:

| Patent No. | Inventor | Dated |
|---|---|---|
| 2,968,256 | C. C. Williams | 1/17/61 |
| 3,563,310 | Wellstein | 2/16/71 |
| 3,430,697 | Wellstein | 3/4/69 |
| 3,722,586 | Baker | 3/27/73 |
| 3,403,730 | Williams | 10/1/68 |
| 3,270,818 | Pugh | 9/6/66 |
| 3,183,973 | Eging | 5/18/65 |
| 2,949,961 | Anderson | 8/23/60 |
| 3,136,362 | Baker | 6/9/64 |
| 3,239,007 | Baker | 3/8/66 |
| 2,903,067 | Hall | 9/8/59 |
| 3,838,735 | Prescott | 10/1/74 |
| 3,161,424 | Maass | 12/15/64 |
| 2,960,166 | Haydin | 11/15/60 |
| 3,805,891 | Reinhard | 4/23/74 |
| 3,324,950 | Andrew | 6/13/67 |
| 3,373,819 | Baker | 3/19/68 |
| 3,645,333 | Maass | 2/29/72 |
| 3,561,796 | Williams | 2/9/71 |
| 3,380,533 | Andrew | 4/30/68 |
| 3,812,910 | Wellstein | 5/28/74 |

The O-ring seal, provided it has sufficient material, can make a good seal against the relatively rough wall of the casing provided it is not damaged in insertion, and further provided that force is evenly applied in a direction normal to the plane of the seal. Since the latter direction is at right angles to the well casing, which is only a few inches in diameter for a typical household installation, and in any case is very little larger than the pitless adapter itself, this presents a problem. Likewise, secure mechanical support of the pitless adapter presents a problem. Preferably, it should not be suspended from the well casing cover because that imposes the entire weight of the pump, the drop pipe, the pitless adapter, and their supports, on the well casing cover. This makes it difficult to seal the cover in a way that is readily removable and makes it necessary to lift the entire weight of the structure within the well casing when removing the cover. The invention described here avoids such problems.

SUMMARY OF THE INVENTION

The above support problem is overcome in part by a projecting hook to support the pitless adapter from the service pipe outlet opening in the well casing. Such a hook is not new in and of itself, but this hook is provided within the area of the O-ring seal and provides support only at one side, without necessarily properly orienting the pitless adapter. Orientation and sealing force are provided by a segment bar or locking member riding in a segment-shaped track on the side of the pitless adapter opposite the outlet opening and O-ring seal. The segment is moved along its track by a force applied to the end of the segment, preferably by a screw which is rotated by the installer. As the screw is rotated, the lower end of the segment moves in an arcuate path to engage the wall of the casing in a radially outward direction, thereby pushing the pitless adapter and the O-ring seal radially in the opposite direction toward the outlet opening to securely seal the outlet opening. Preferably the end of the locking member engages the well casing wall at a level slightly above the support surface of the hook.

The segment is itself desirably provided with at least one arcuate track or groove facing a wall of the channel or track in the pitless adapter, in which is placed a retainer such as a rubber ball or pellet to increase the friction between the locking segment and the channel in which it rides so that the segment will not fall into a wall-engaging position prematurely during insertion of the pitless adapter in the well, but will remain retracted until the screw is rotated to force it against the wall at the correct time. Once installation is complete, the segment-advancing screw is left in place and therefore it is substantially impossible for the segment to move and for the seal around the outlet to loosen, until the installer returns and backs off the segment-advancing screw. When that has been done, it is possible to attach lifting means to the pitless adapter and lift it out of its installed position. The contact between the casing wall and the segment will retract the sector sufficiently so that the pitless adapter may be lifted out of the well for service of whatever component requires it. While another downwardly acting mechanism could be used to bear on the top of the segment to force the other end of the sector radially outwardly, a screw is particularly appropriate because although the screw is readily rotated with an appropriate tool, it is completely locked against axial movement that would be required to release the sector and allow the pitless adapter to be moved out of its installed position. Thus the combination of the sector and the screw provide an extremely secure installation mechanism.

The sector itself is preferably trapezoid shaped in cross section and rides in an arcuate channel having a corresponding trapezoidal cross section. Other cross sections could be used provided they securely retain the arcuate locking sector in the channel. The hook protects the O-ring during installation.

DRAWINGS

FIG. 3 is a lateral cross sectional view on line 3—3 of FIG. 1.

FIG. 4 is an exploded perspective view of the segment and retainers of my device showing the manner in which the retainers enter the channels in the locking segment.

DETAILED DESCRIPTION

Figure 2:
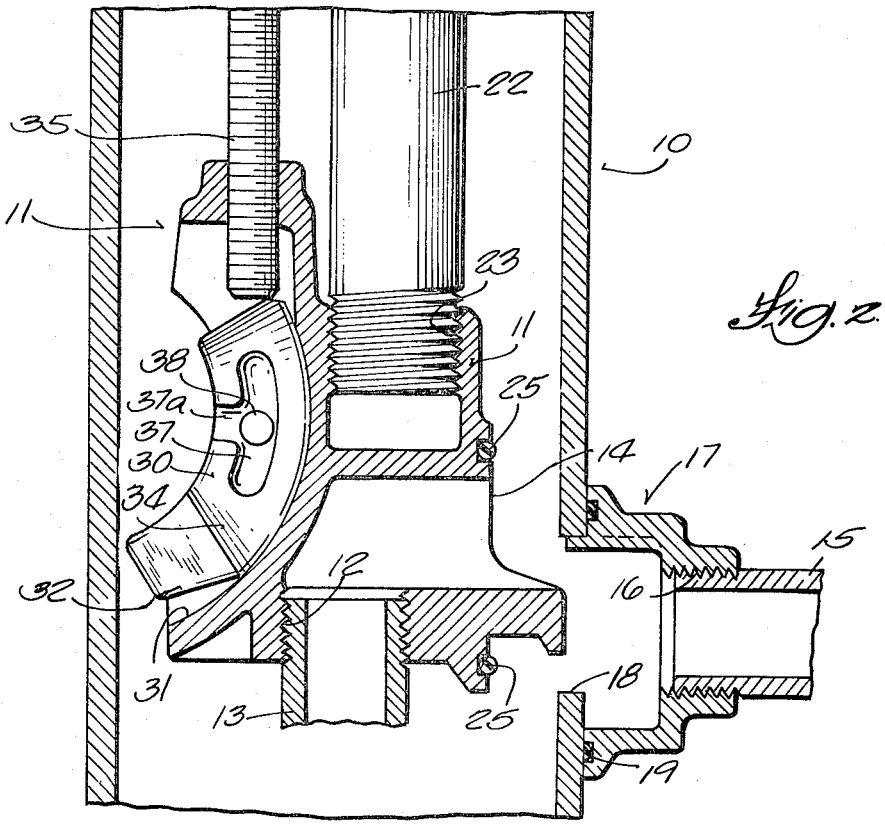
FIG. 2 is a vertical cross sectional view through a well casing showing the pitless adapter of my invention being installed.

Although the disclosure hereof is detailed and exact to enable those skilled in the art to practice the invention, the physical embodiments herein disclosed merely exemplify the invention which may be embodied in other specific structure. While the best known embodiment has been described, the details may be changed without departing from the invention, which is defined by the claims.

In a well casing 10 is a pitless adapter 11 provided with a drop pipe opening 12 into which a drop pipe 13 is threaded. The adapter has an outlet opening 14, from which water pumped by conventional means at the lower end of the drop pipe 13, pump 26, may enter a water line or service pipe 15. Pipe 15 is received in a service pipe opening 16 in an outlet fitting 17 sealed to the well casing 10 around an opening 18 by means of an O-ring 19, and secured with conventional U-bolts 24, or the like. Preferably the outlet fitting 17 is provided with a lip 21 within the upper part of the casing opening 18 to position the outlet fitting properly within the opening 18. The lower part of fitting 17 is well below casing opening 18 in order to receive a downwardly projecting hook 20 which is part of the pitless adapter. The pitless adapter 11 is sealed around outlet 14 and casing opening 18 by an O-ring 25.

The pitless adapter 11 may desirably be temporarily supported, along with the drop pipe 13 and the pump means 26 at the bottom of the drop pipe by a length of pipe 22 screwed into a socket 23 at the top of the pitless adapter.

Figure 1:
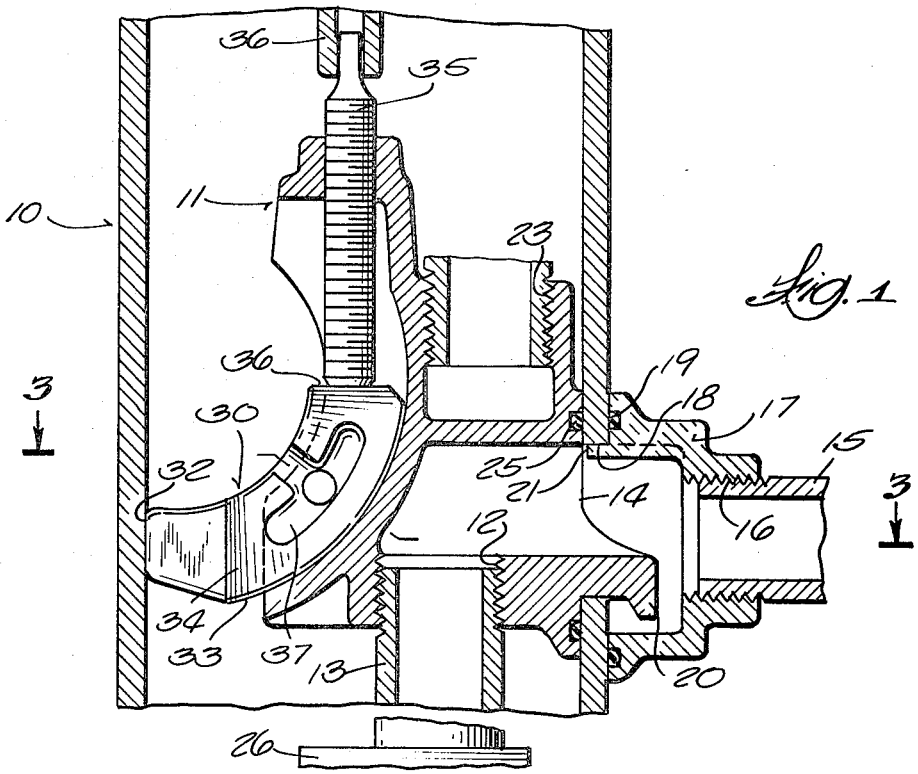
FIG. 1 is a view showing the pitless adapter of my invention after it has been installed.

The important part of my invention is the locking means or member 30 which is segment shaped when viewed from the side and which is preferably trapezoid shaped in lateral cross sectional form. The segment or locking member 30 is received within a complementary channel 31 curved to match the curvature of the segment shape and shaped in lateral cross section to match the shape of the base of the trapezoidal cross section. (FIGS. 1–3). The complementary shapes of the locking member 30 and of channel 31 give smooth arcuate movement to the locking member to convert vertical control pressure to horizontal locking pressure pressing the pitless adapter 11 against opening 18 in well casing 10. Since the pressure is exerted by end 32 of the locking member 30 engaging the wall of casing 10 within a horizontal projection of the space enclosed by O-ring 25 and the force is transmitted to pitless adapter 11 through the entire back wall 33 of segment 30 (the base of the trapezoid) the sealing pressure on O-ring 25 is very uniform. Because of the trapezoidal lateral cross sectional form of segment 30, the side walls 34 are trapped in channel 31. Other cross sectional forms which trap the locking member 30 but permit it to slide in an arc may also be adopted but the trapezoid shape is extremely simple and effective.

Preferably force is applied to segment 30 by means of a screw 35 pressing on upper end 36 of segment 30. A tool 36 is temporarily placed over the end of screw 35 to rotate it during installation or removal. When the screw is rotated downward a high force is produced between the screw and screw threads, as is well known, which forces segment 30 down channel 31 so that end 32 contacts the wall of well casing 10. As this high force is applied the segment 30 applies force all along its back face 33 to the pitless adapter 11 sliding hook 20 inwardly and making a good seal at O-ring 25 as shown in FIG. 1. When the screw 35 is backed off in order to remove the pitless adapter 11 from the well casing 10 the sealing pressure is relieved but the segment 30 does not immediately move. The weight of the pump and drop pipe on the pitless adapter 11 hanging from hook 20 keeps it stable, and of course segment 30 would have to rise slightly to withdraw from well casing 10.

In addition, there is a special mechanism to give stability to the position of segment 30. Segment 30 is provided with an arcuate slot 37 parallel to wall 33 in one or both of side walls 34. A retaining member 38 (FIG. 4) or other resilient shapes that fit within channel 37 are inserted in channels 37 after the segment is assembled to the pitless adapter 11 by inserting them through side channel **37*a* and forcing them into place in channel 37. Members 38 should be of such a dimension that they are compressed as they are inserted. Since that is the case, as segment 30 moves in channel 31 retaining members 38 roll resiliently in channel 37 against the walls of channels 31 (see FIG. 1) and thereby serve to retain segment 30 in any adjusted position. When the segment is released from sealing pressure by backing off screw 35 members 38 continue to hold it in position until the pitless adapter 11 is lifted by pipe 22. At that time the weight of the drop pipe and pump are brought toward the center of well casing 10, and especially as the sloped upper surface of hook 20 rides against casing opening 18 as the pitless adapter is lifted. This pushes against end 32 of segment 30 and retracts the segment upwardly and inwardly into channel 31 where it is again held in a stable position by retaining means 38. As the pitless adapter 11 is lifted out of casing 10 segment 30 would tend to fall out of groove 31 were it not for retaining means 38. If desired, an alternate retaining means may engage channel 37 such as a rigid pin in the wall of pitless adapter 11 which is put in place after segment 30 is inserted in channel 31, or set screws may also perform that function. However, the preferred form of retaining means 38 is an elastic ball of a size requiring it to be compressed in inner groove 37. The unusual segment and trapezoid form of locking member 30 and the use of a resilient retaining member 38 to retain and position the locking member are exceptionally effective in providing a good secure seal which is readily released and which remains in adjusted position through the action of retaining member 38**.

The form of the pitless adapter which places the screw and screw housing above the segment not only provides for considerable locking force but also protects the top of the segment and channel from materials falling into the well while the well cover is open. Another advantage of the described design is that the parts can be cast in their entirety, with only reaming and tapping required for finishing operations. They are also extremely rugged because they lack small projecting arms or other small parts which may break. The tolerances need not be too close because only a single end of the locking member 30 must touch the well casing and this design is a particularly effective way to suspend the pitless adapter from the well casing opening without attachments at the top of the casing.

Whenever the word "segment" is used herein to describe the locking member it is intended to mean a shape which has at least one boundary that is an arc of a circle, without necessarily extending to the axis of the circle, and having at least enough axial extent to impart rigidity to the locking member.

I claim:

1. In a pitless adapter for use in a well casing to direct water flow through an opening in the well casing to a service pipe, the improvement comprising:

a seal between the pitless adapter and the well casing protected by a projection within the seal area, a segment shaped locking member movable respecting said adapter downwardly and outwardly away from the seal in a segment shaped track in the adapter to firmly engage a well casing wall, and means to cause said movement and to retain said member in actuated position.

2. The device of claim 1 in which the actuating means is a screw.

3. The device of claim 1 in which the locking member is trapezoid shaped in lateral cross section and further comprising a complementary channel to receive the base of the trapezoid in the pitless adapter.

4. The device of claim 1 in which one of the locking member and the pitless adapter has a groove parallel to the path of movement of the locking member and facing a wall of the other of said locking member and said adapter, and a resiliently deformable means in said groove to maintain the locking member in adjusted position respecting the adapter.

* * * * *